US006471152B1

(12) United States Patent
Suzuki et al.

(10) Patent No.: US 6,471,152 B1
(45) Date of Patent: Oct. 29, 2002

(54) DANCER ROLL MECHANISM AND WEB FEEDING APPARATUS INCORPORATING SUCH DANCER ROLL MECHANISM

(75) Inventors: Kiyohito Suzuki, Odawara (JP); Katsumi Takemi, Odawara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 112 days.

(21) Appl. No.: 09/637,683

(22) Filed: Aug. 14, 2000

(30) Foreign Application Priority Data

Aug. 12, 1999 (JP) ..... 11-228500

(51) Int. Cl.[7] ..... B65H 23/18

(52) U.S. Cl. ..... 242/417.3; 242/419.7; 226/44; 226/118.3

(58) Field of Search ..... 242/413.1, 417.1, 242/417.2, 417.3, 419.7; 226/44, 118.3

(56) References Cited

U.S. PATENT DOCUMENTS 509,413 A * 11/1893 Wardwell, Jr. ..... 242/417.3
2,067,755 A * 1/1937 Dyer, Jr. ..... 226/44
3,650,490 A * 3/1972 Saunders ..... 242/417.3
3,822,832 A * 7/1974 Torii et al. ..... 242/413.5
4,318,513 A * 3/1982 Martinez ..... 242/417.3
5,797,532 A * 8/1998 Flagg ..... 242/417.3
6,024,319 A * 2/2000 Kawabata et al. ..... 226/118.3

* cited by examiner

*Primary Examiner*—William A. Rivera
(74) *Attorney, Agent, or Firm*—Sughrue Mion, PLLC

(57) ABSTRACT

A dancer roll device has a support assembly that supports a roll. A ball screw is rotatably mounted on the support assembly. A weight member is mounted on the ball screw by a nut member that is threaded over the ball screw. When the ball screw is rotated about its own axis by a motor, the nut member and the weight member are displaced along the ball screw, thereby displacing the center of gravity of the support assembly. The moment applied to the roll is changed, thus changing the tension that is applied to a wide web or a narrow web via the roll.

14 Claims, 6 Drawing Sheets

DANCER ROLL MECHANISM AND WEB FEEDING APPARATUS INCORPORATING SUCH DANCER ROLL MECHANISM

BACKGROUND OF THE INVENTION

1. Filed of the Invention

The present invention relates to a dancer roll mechanism that is capable of controlling the tension to be applied to a web with high accuracy, and a web feeding apparatus that incorporates such a dancer roll mechanism.

2. Description of the Related Art

Heretofore, dancer roll devices have been used to control the tension to be applied to a web that is fed along. The dancer roll devices comprise a roll, a lever by which the roll is supported, and an air cylinder for adjusting the moment imposed on the roll through the lever. The air cylinder is supplied with air whose pressure is regulated by an electro pneumatic transducer based on an instruction given from a controller.

However, the air cylinder tends to cause a delay in its response to the instruction given from the controller. Consequently, the dancer roll device with the air cylinder is liable to suffer an error in controlling the tension to be applied to the web.

In addition, a back pressure developed when the air from the air cylinder is discharged via the electro pneumatic transducer and a resistance to the sliding movement in the air cylinder are also likely to bring about an error in controlling the tension to be applied to the web.

As a result, the dancer roll device with the air cylinder tends to fail to control the web tension with high accuracy.

SUMMARY OF THE INVENTION

It is therefore an object of the present invention to provide a dancer roll mechanism that is capable of controlling the tension to be applied to a web with high accuracy, and a web feeding apparatus, which incorporates such a dancer roll mechanism.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A preferred embodiment of a dancer roll mechanism and a web feeding apparatus that incorporates such a dancer roll mechanism will be described in detail below with reference to the drawings.

Figure 1:
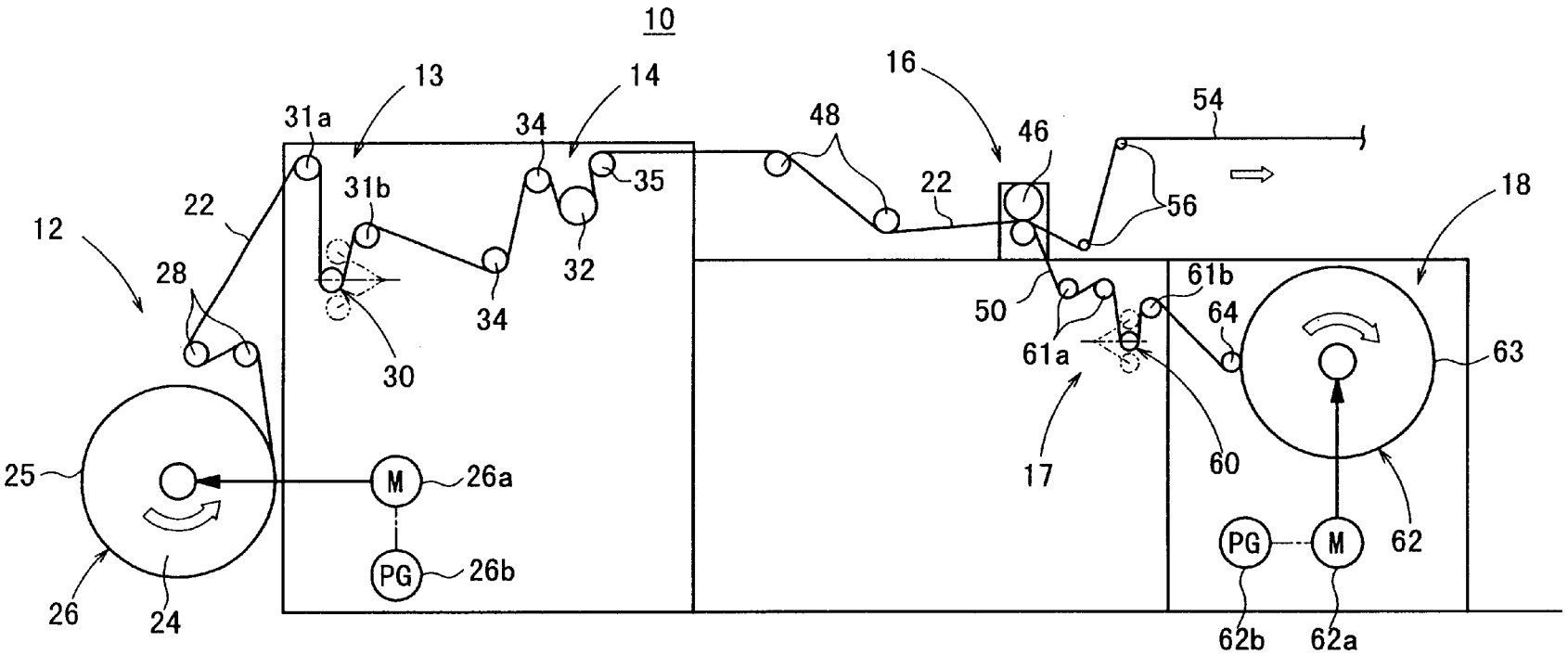
FIG. 1 is a schematic side elevational view of a web cutting apparatus according to an embodiment of the present invention.

FIG. 1 shows in schematic side elevation a web cutting apparatus 10 that includes the dancer roll mechanism and the web feeding apparatus.

As shown in FIG. 1, the web cutting apparatus 10 has a payout unit 12, a payout tension adjuster 13, a reference unit 14, a slitting unit 16, a winding tension adjuster 17, and a take-up unit 18. The payout unit 12, the payout tension adjuster 13, the reference unit 14, the winding tension adjuster 17, and the take-up unit 18 jointly make up the web feeding apparatus according to the present invention.

The payout unit 12 has an unwinder 26 for unwinding a blank web 24 on a roll core 25 which comprises a rolled wide web 22 of film, e.g., magnetic tape base film, paper, metal foil, or the like.

The unwinder 26 has a motor 26*a* for rotating the blank web 24 and a pulse generator (PG) 26*b* for generating pulses depending on the angular movement of the motor 26*a*. The pulse generator 26*b* includes an encoder, a resolver, etc. Other pulse generators 62*b*, 102, to be described later on, also include an encoder, a resolver, etc.

When the motor 26*a* is energized, the side web 22 unwound from the blank web 24 is supplied via guide rolls, i.e., web feed rolls, 28 to the payout tension adjuster 13.

The payout tension adjuster 13 has a dancer roll device 30 that serves as the dancer roll mechanism according to the present invention. The wide web 22 paid out from the payout unit 12 is supplied via a guide roll, i.e., a web feed roll, 31*a* to the dancer roll device 30.

The dancer roll device 30 controls the tension that is applied to the wide web 22 when the wide web 22 is unwound from the blank web 24. The wide web 22 that has traveled through the dancer roll device 30 is supplied via a guide roll, i.e., a web feed roll, 31*b* to the reference unit 14.

The reference unit 14 has a reference roll, i.e., a web feed roll, 32. The wide web 22 fed from the payout tension adjuster 13 is supplied via guide rolls, i.e., web feed rolls, 34 to the reference roll 32. The wide web 22 is fed by the reference roll 32 via a guide roll, i.e., a web feed roll, 35 to the slitting unit 16.

The slitting unit 16 has a slitter blade 46. The side web 22 fed from the reference unit 14 is supplied via guide rolls, i.e., web feed rolls, 48 to the slitter blade 46. The slitter blade 46 cuts off the wide web 22 into a narrow web 50, which is supplied to the winding tension adjuster 17. Longitudinal edges 54 that are severed off the wide web 22 are supplied via guide rolls, i.e., web feed rolls, 56 to an edge take-up unit (not shown).

The winding tension adjuster 17 also has a dancer roll device 60 that serves as the dancer roll mechanism according to the present invention. The narrow web 50 delivered from the slitting unit 16 is supplied via guide rolls, i.e., web feed rolls, 61*a* to the dancer roll device 60.

The tension that is applied to the narrow web 50 when the narrow web 50 is wound by a take-up device 62, to be described later on, is controlled by the dander roll device 60. The narrow web 50 delivered from the dancer roll device 60 is supplied via a guide roll, i.e., a web feed roll, 61*b* to the take-up unit 18.

The take-up unit 18 has the take-up device 62 for winding the narrow web 50. The take-up device 62 has a motor 62*a* for rotating a roll core 63 and a pulse generator (PG) 62*b* for generating pulses depending on the angular movement of the motor 62*a*. The narrow web 50 delivered from the winding tension adjuster 17 via a guide roll, i.e., a web feed roll, 64 is wound around the roll core 63 of the take-up device 62 when the motor 62*a* is energized.

Structural details of the dancer roll devices 30, 60 will be described below.

Figure 2:
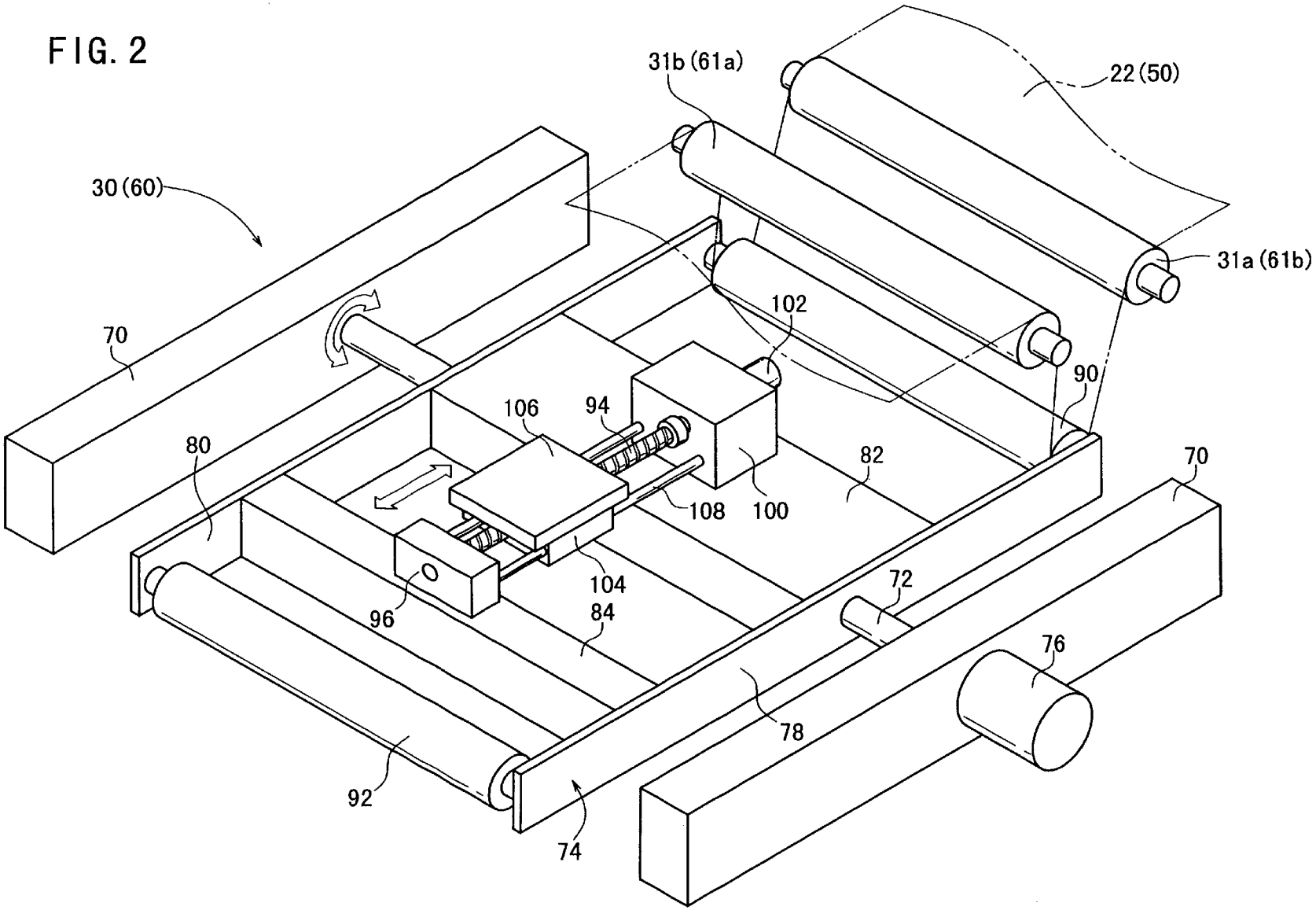
FIG. 2 is a perspective view of a dancer roll device of the web cutting apparatus shown in FIG. 1.

FIG. 2 shows the dancer roll device 30 of the payout tension adjuster 13 and the dancer roll device 60 of the winding tension adjuster 17. Since the dancer roll devices 30, 60 are virtually identical in construction to each other, their components are denoted by identical reference numerals.

Each of the dancer roll devices 30, 60 has a rotatable shaft 72 rotatably supported by a support member 70. On the rotatable shaft 72, there are fixedly mounted laterally spaced side plates 78, 80 and a base plate 82 extending between the side plates 78, 80. The side plates 78, 80 and the base plate 82 make up a support assembly 74, to be described later on.

An angle detector 76 for detecting angular displacements θa1, θa2 of the rotatable shafts 72, respectively, of the dancer roll devices 30, 60 is mounted on the support member 70. The angle detector 76 may comprise an encoder, a resolver, etc.

The support assembly 74 includes, in addition to the side plates 78, 80 and the base plate 82, a base plate 84 fixedly disposed between the side plates 78, 80 parallel to the base plate 82. A roll, i.e., a dancer roll, 90 is rotatably supported on ends of the side plates 78, 80, and a counterweight 92 is supported on opposite ends of the side plates 78, 80.

Each of the dancer roll devices 30, 60 has a ball screw 94 disposed between and extending parallel to the side plates 78, 80. The ball screw 94 has an end coupled to the drive shaft of a motor, i.e., an actuator, 100 fixedly mounted on the base plate 82. The other end of the ball screw 94 is rotatably supported by a bearing (not shown) in a bearing unit 96 that is fixedly mounted on the base plate 84. The ball screw 94 has an axis extending substantially perpendicularly to the axis of the rotatable shaft 72.

To the motor 100, there is connected a pulse generator (PG) 102 for generating pulses depending on the angular movement of the motor 100.

A movable nut member 104 is threaded over the ball screw 94. Specifically, the movable nut member 104 has an internally threaded hole (not shown) that is threaded over the ball screw 94. A weight member 106 is mounted on the nut member 104.

The nut member 104 is guided by a pair of guide rods 108 extending parallel to the ball screw 94 between the motor 100 and the bearing unit 96. When the ball screw 94 is rotated about its own axis by the motor 100, the nut member 104 and the weight member 106 move in one direction or the other along the ball screw 94. The ball screw 94, the motor 100, and the nut member 104 jointly serve as a weight displacing assembly of each of the dancer roll devices 30, 60.

When the weight member 106 is displaced by the weight displacing assembly, the center of gravity of the support assembly 74 is displaced, thus changing the moment M applied to the roll 90.

The ball screw 94, the motor 100, the nut member 104, and the weight member 106 jointly make up a center-of-gravity displacing mechanism of each of the dancer roll devices 30, 60.

The center-of-gravity displacing mechanism causes the roll 90 to control the tension T applied to the wide web 22 or the narrow web 50.

Though the wide web 22 or the narrow web 50 have different transverse dimensions or widths in reality, they are shown as having the same width in FIG. 2 for an easier understanding of the dancer roll devices 30, 60.

A control mechanism of the web cutting apparatus 10 will be described below.

Figure 3:
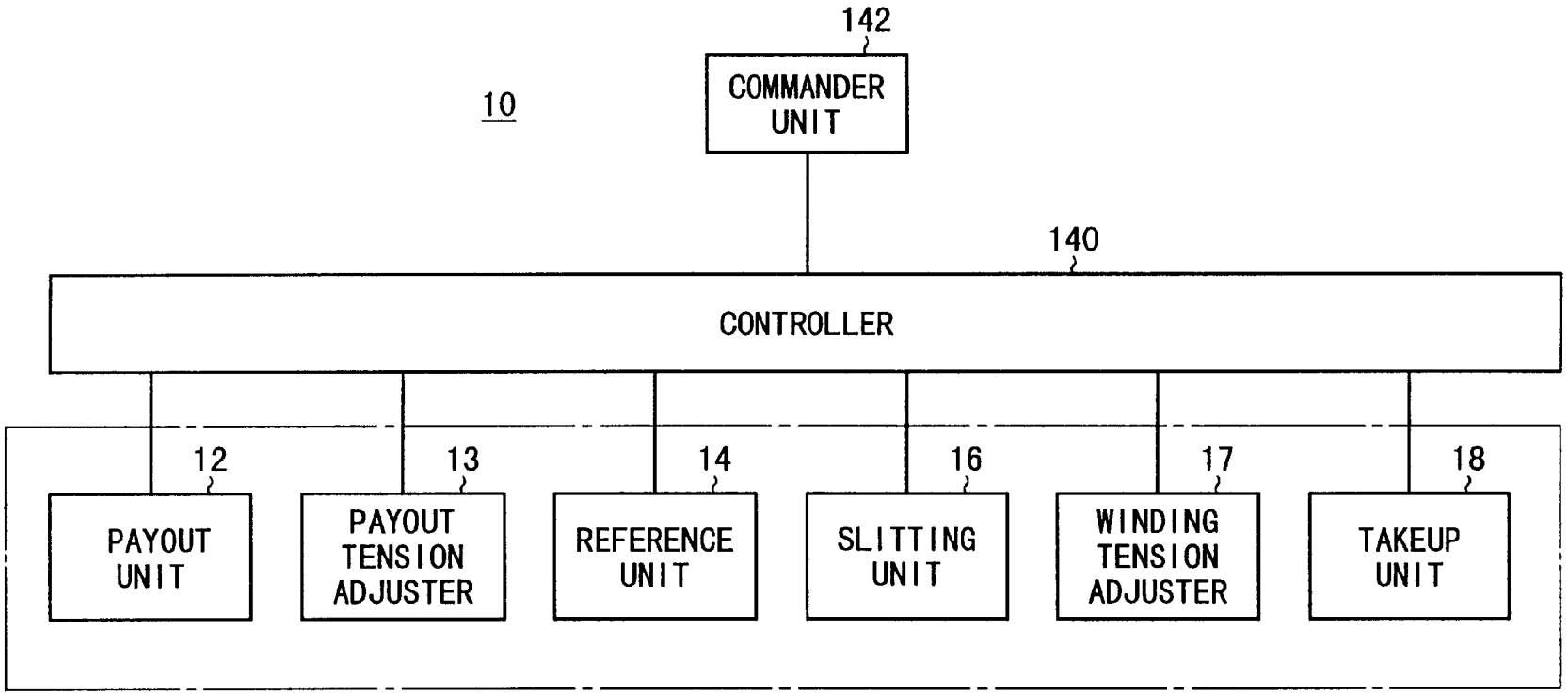
FIG. 3 is a block diagram of the web cutting apparatus shown in FIG. 1.

FIG. 3 shows in block form the web cutting apparatus 10. As shown in FIG. 3, the web cutting apparatus 10 has a controller 140 that is electrically connected to actuators or motors and sensors in the payout unit 12, the payout tension adjuster 13, the reference unit 14, the slitting unit 16, the winding tension adjuster 17, and the take-up unit 18.

As shown in FIGS. 2 and 3, the controller 140 is electrically connected to the angle detector 76, the motor 100 or actually a driver for driving the driver 100, and the pulse generator 102, etc. of the dancer roll devices 30, 60 in the payout tension adjuster 13 and the winding tension adjuster 17.

As shown in FIGS. 1 and 3, the controller 140 is electrically connected to the motor 26*a* and the pulse generator 26*b*, etc. of the unwinder 26 in the payout unit 12, and is also electrically connected to the motor 62*a* and the pulse generator 62*b*, etc. of the take-up device 62 in the take-up unit 18.

As shown in FIG. 3, a commander unit 142 for entering various settings or the like into the controller 140 is electrically connected to the controller 140.

Means in the controller 140 for controlling the tension applied to the wide web 22 and the narrow web 50 will be described below.

Figure 4:
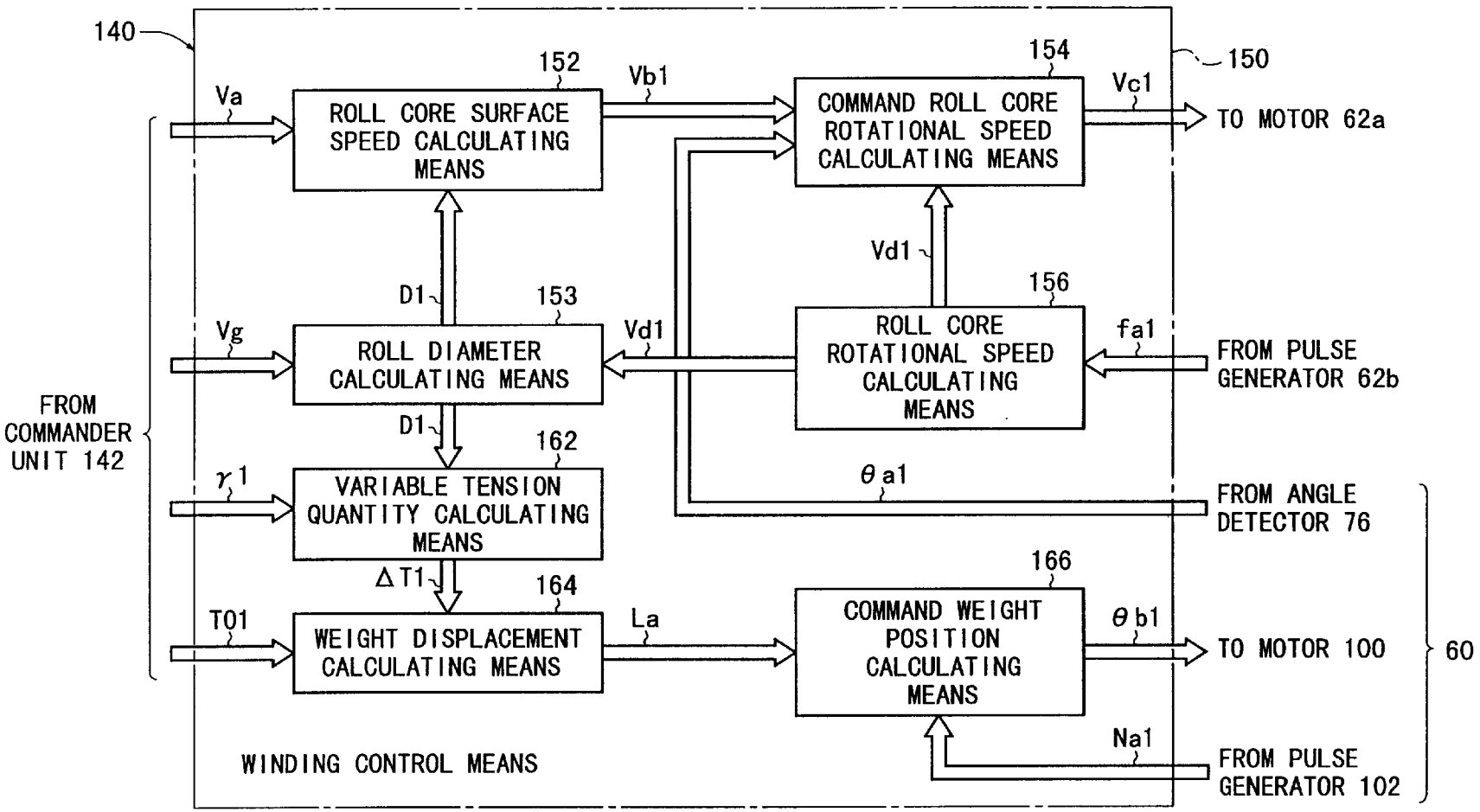
FIG. 4 is a functional block diagram of a winding control means of a controller of the web cutting apparatus shown in FIG. 3.

FIG. 4 shows in functional block form a winding control means 150 of the controller 140. The winding control means 150 primarily controls the take-up unit 18, particularly the take-up device 62, and the winding tension adjuster 17, particularly the dancer roll device 60.

The winding control means 150 has a roll core surface speed calculating means 152, a roll diameter calculating means 153, a command roll core rotational speed calculating means 154, and a roll core rotational speed calculating means 156.

The roll core surface speed calculating means 152 determines a desired surface speed Vb1 for the roll core 63 in the take-up device 62 based on a line speed command Va supplied from the commander unit 142 and a roll diameter D1, to be described later on, from the roll diameter calculating means 153, and supplies the determined surface speed Vb1 to the command roll core rotational speed calculating means 154.

The line speed command Va represents a desired feed speed for the wide web 22 and/or the narrow web 50, and may be given as the rotational speed of the slitter blade 46. The roll core 63 in the take-up device 62 represents the narrow web 50 that is actually wound, and provides a surface of the actually wound narrow web 50.

The command roll core rotational speed calculating means 154 determines a desired rotational speed, i.e., a command rotational speed, Vc1 for the motor 62*a* of the take-up device 62 based on the desired surface speed Vb1 from the roll core surface speed calculating means 152, an actual rotational speed Vd1, to be described later on, from the roll core rotational speed calculating means 156, and the angular displacement θa1 from the angle detector 76 of the dancer roll device 60. The angular displacement θa1 is supplied via an A/D converter, not shown, to the command roll core rotational speed calculating means 154.

The command roll core rotational speed calculating means 154 supplies the determined rotational speed Vc1 to a driver, not shown, for the motor 62*a* to energize the motor 62*a* to rotate at the supplied rotational speed Vc1. When the motor 62*a* is energized, it rotates the roll core 62 of the take-up device 62 at the desired surface speed Vb1, winding the narrow web 50 on the roll core 63.

The roll core rotational speed calculating means 156 is supplied with a frequency fa1 based on the angular velocity of the motor 62*a* from the pulse generator 62*b* connected to the motor 62*a*. The frequency fa1 is supplied via an A/D converter, not shown, to the roll core rotational speed calculating means 156. The frequency fa1 represents the frequency of pulses generated by the pulse generator 62*b*.

Based on the supplied frequency fa1, the roll core rotational speed calculating means 156 determines an actual rotational speed Vd1 of the motor 62*a*. The roll core rotational speed calculating means 156 supplies the determined actual rotational speed Vd1 to the command roll core rotational speed calculating means 154 and the roll diameter calculating means 153.

The roll diameter calculating means 153 determines a roll diameter D1, including the thickness of the narrow web 50, of the roll core 63 based on the actual rotational speed Vd1 from the roll core rotational speed calculating means 156 and a reference motor speed Vg supplied from the commander unit 142. The roll diameter calculating means 153 supplies the determined roll diameter D1 to the roll core surface speed calculating means 152 and a variable tension quantity calculating means 162, to be described later on.

The reference motor speed Vg represents the rotational speed of a motor, not shown, for rotating the reference roll 32. The reference motor speed Vg is determined based on a speed pattern that has been determined depending on the line speed command Va.

The winding control means 150 also has the variable tension quantity calculating means 162, a weight displacement calculating means 164, and a command weight position calculating means 166.

The variable tension quantity calculating means 162 determines a variable quantity ΔT1 of the tension T to be applied to the narrow web 50 based on the roll diameter D1 from the roll diameter calculating means 153 and a tension varying ratio setting γ1 from the commander unit 142. The variable tension quantity calculating means 162 supplies the determined variable quantity ΔT1 to the weight displacement calculating means 164.

The tension varying ratio setting γ1 is a setting, e.g. , a constant, for determining a reduction ratio for the tension T with respect to an increase in the roll diameter D1. Therefore, the tension T is reduced as the roll diameter D1 increases, i.e., the tension T is reduced in inverse proportion to the roll diameter D1.

The weight displacement calculating means 164 determines a displacement La for the nut member 104, i.e., a distance that the nut member 104 is to be displaced, based on the variable quantity ΔT1 from the variable tension quantity calculating means 162 and/or a reference value, i.e., a tension setting, T01 for the tension T from the commander unit 142. The displacement La represents a positional command for the weight member 106.

The command weight position calculating means 166 determines a desired angular displacement, i.e., a command angular displacement, θb1 for the motor 100 based on the displacement La from the weight displacement calculating means 164 and the number Na1 of pulses from the pulse generator 102 of the dancer roll device 60.

The number Na1 of pulses represents the number of pulses based on the angular displacement of the motor 100, and is supplied from the pulse generator 102 via an A/D converter, not shown, to the command weight position calculating means 166.

The command weight position calculating means 166 supplies the command angular displacement θb1 to the driver, not shown, of the motor 100 to energize the motor 100 to rotate for the command angular displacement θb1. When the motor 100 is energized, it rotates the ball screw 94 about its own axis to move the nut member 104 and the weight member 106 therealong. The movement of the weight member 106 changes the moment M applied to the roll 90 of the dancer roll device 60. The tension T that is applied via the roll 90 to the narrow web 50 is controlled at a desired value based on the tension setting T01 and/or the variable quantity ΔT1.

Figure 5:
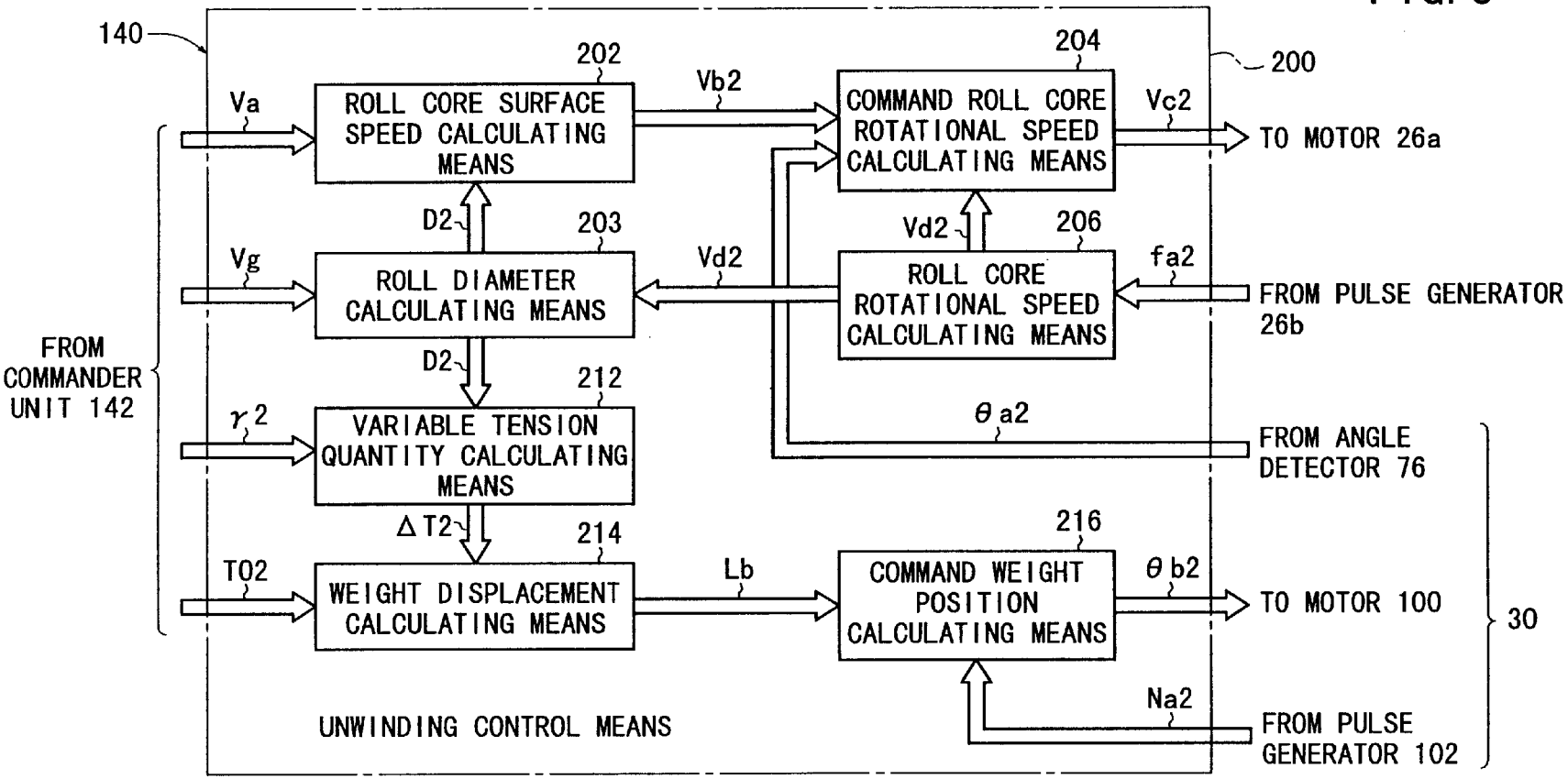
FIG. 5 is a functional block diagram of an unwinding control means of the controller of the web cutting apparatus shown in FIG. 3.

FIG. 5 shows in functional block form an unwinding control means 200 of the controller 140. The unwinding control means 200 primarily controls the payout unit 12, particularly the unwinder 26, and the payout tension adjuster 13, particularly the dancer roll device 30.

The unwinding control means 200 has a roll core surface speed calculating means 202, a roll diameter calculating means 203, a command roll core rotational speed calculating means 204, and a roll core rotational speed calculating means 206.

The roll core surface speed calculating means 202, the roll diameter calculating means 203, the command roll core rotational speed calculating means 204, and the roll core rotational speed calculating means 206 perform the same processing operation as the roll core surface speed calculating means 152, the roll diameter calculating means 153, the command roll core rotational speed calculating means 154, and the roll core rotational speed calculating means 156, respectively, of the winding control means 150 (see FIG. 4).

Specifically, the roll core surface speed calculating means 202 determines a desired surface speed Vb2 for the roll core 25 of the blank web 24 based on a line speed command Va supplied from the commander unit 142 and a roll diameter D2, to be described later on, from the roll diameter calculating means 203.

The command roll core rotational speed calculating means 204 determines a command rotational speed Vc2 for the motor 26*a* of the unwinder 26 based on the desired surface speed Vb2 from the roll core surface speed calculating means 202, an actual rotational speed Vd2, to be described later on, from the roll core rotational speed calculating means 206, and the angular displacement θa2 from the angle detector 76 of the dancer roll device 60. The angular displacement θa2 is supplied via an A/D converter, not shown, to the command roll core rotational speed calculating means 204.

The command roll core rotational speed calculating means 204 supplies the determined rotational speed Vc2 to a driver, not shown, for the motor 26*a* to energize the motor 26*a* to rotate at the supplied rotational speed Vc2. When the motor 26*a* is energized, it rotates the roll core 25 of the unwinder 26 at the desired surface speed Vb2, unwinding the wide web 22 from the roll core 25.

The roll core rotational speed calculating means 206 determines an actual rotational speed Vd2 of the motor 26*a* based on a frequency fa2 supplied via an A/D converter, not shown, from the pulse generator 26*b*.

The roll diameter calculating means 203 determines a roll diameter D2, including the thickness of the wide web 22, of the roll core 25 of the blank web 24 based on the actual rotational speed Vd2 from the roll core rotational speed calculating means 206 and a reference motor speed Vg supplied from the commander unit 142. The roll diameter calculating means 203 supplies the determined roll diameter D2 to the roll core surface speed calculating means 202 and a variable tension quantity calculating means 212, to be described later on.

The unwinding control means 200 also has the variable tension quantity calculating means 212, a weight displacement calculating means 214, and a command weight position calculating means 216.

The variable tension quantity calculating means 212, the weight displacement calculating means 214, and the command weight position calculating means 216 perform the same processing operation as the variable tension quantity calculating means 162, the weight displacement calculating means 164, and the command weight position calculating means 166, respectively, of the winding control means 150.

The variable tension quantity calculating means 212 determines a variable quantity ΔT2 of the tension T to be applied to the wide web 22 based on the roll diameter D2 from the roll diameter calculating means 203 and a tension varying ratio setting γ2 from the commander unit 142.

The tension varying ratio setting γ2 is a setting, e.g., a constant, for determining an increase ratio for the tension T with respect to a reduction in the roll diameter D2. Therefore, the tension T is increased as the roll diameter D2 decreases, i.e., the tension T is increased in inverse proportion to the roll diameter D2.

The weight displacement calculating means 214 determines a displacement Lb for the nut member 104, i.e., a distance that the nut member 104 is to be displaced, based on the variable quantity ΔT2 from the variable tension quantity calculating means 212 and/or a tension setting T02 for the tension T from the commander unit 142. The displacement Lb represents a positional command for the weight member 106.

The command weight position calculating means 216 determines a desired angular displacement, i.e., a command angular displacement, θb2 for the motor 100 based on the displacement Lb from the weight displacement calculating means 214 and the number Na2 of pulses from the pulse generator 102 of the dancer roll device 30.

The number Na2 of pulses represents the number of pulses based on the angular displacement of the motor 100, and is supplied from the pulse generator 102 via an A/D converter, not shown, to the command weight position calculating means 216.

The command weight position calculating means 216 supplies the command angular displacement θb2 to the driver, not shown, of the motor 100 to energize the motor 100 to rotate for the command angular displacement θb2. When the motor 100 is energized, it rotates the ball screw 94 to move the nut member 104 and the weight member 106 therealong. The movement of the weight member 106 changes the moment M applied to the roll 90 of the dancer roll device 30. The tension T that is applied via the roll 90 to the wide web 22 is controlled at a desired value based on the tension setting T02 and/or the variable quantity ΔT2.

Figure 6:
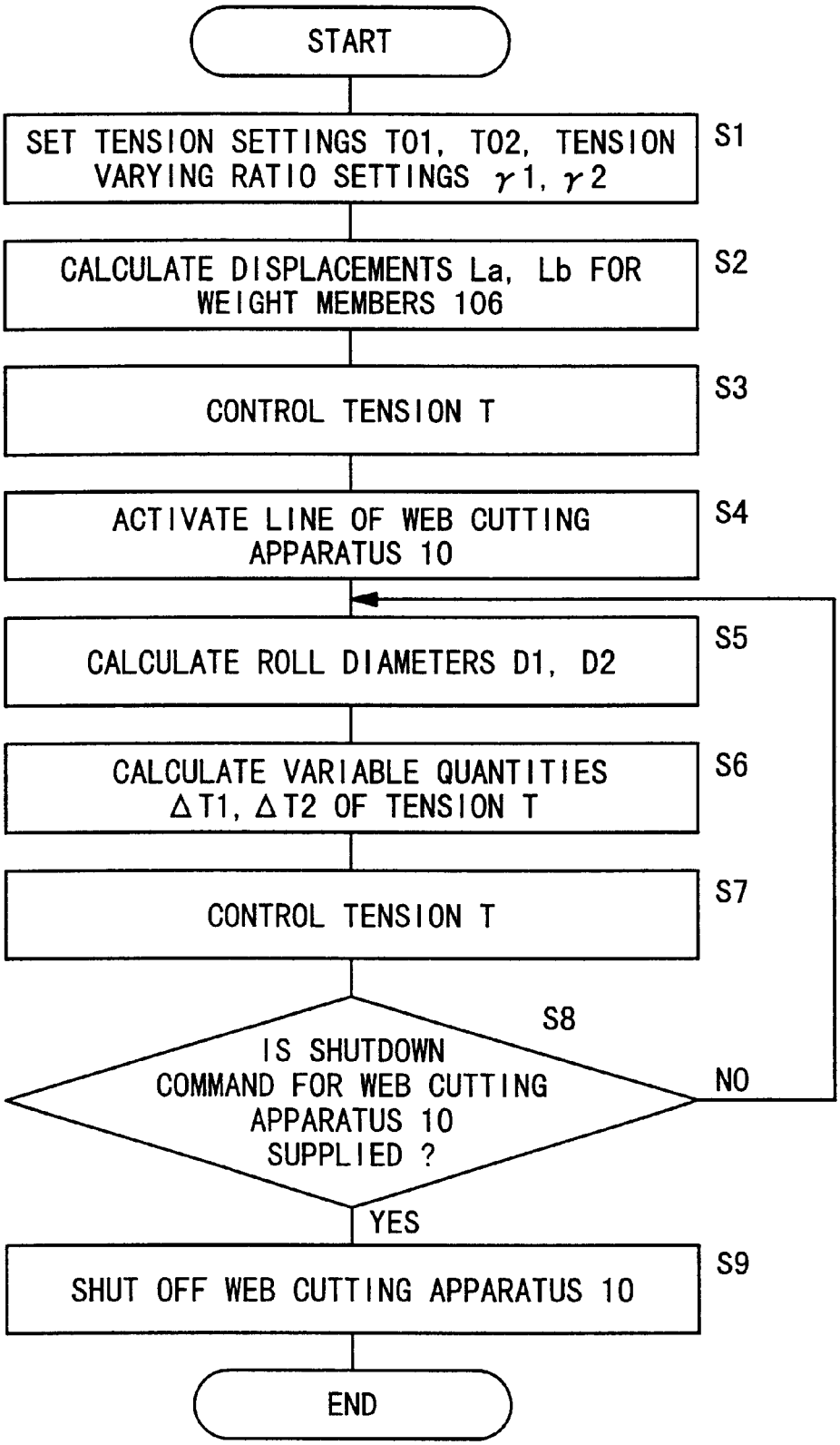
FIG. 6 is a flowchart of a processing sequence of a process of controlling operation of the web cutting apparatus, which is carried out by the controller shown in FIG. 3.

A process performed by the controller 140 for controlling operation of the web cutting apparatus 10 will be described below with reference to FIG. 6.

In step S1, the commander unit 142 sets tension settings T01, T02 and tension varying ratio settings γ1, γ2 in the controller 140.

In step S2, mainly the weight displacement calculating means 164, 214 of the controller 140 determine respective displacements La, Lb for the weight members 106 based on the tension settings T01, T02.

In step S3, mainly the command weight position calculating means 166, 216 of the controller 140 determine respective command angular displacements θb1, θb2 for the motors 100 based on the displacements La, Lb determined in step S2. The controller 140 supplies the determined command angular displacements θb1, θb2 as positional commands to the motors 100.

When the motors 100 are rotated, the weight members 106 are displaced from a reference position, for example, by the respective displacements La, Lb. As the weight members 106 are thus displaced, the tensions T based on the tension settings T01, T02 are applied respectively to the narrow web 50 and the wide web 22.

In step S4, the controller 140 outputs startup instructions to the payout unit 12, the reference unit 14, the slitting unit 16, and the take-up unit 18. Based on the startup instructions, the payout unit 12, the reference unit 14, the slitting unit 16, and the take-up unit 18, i.e., the line of the web cutting apparatus 10, are activated.

In step S5, mainly the roll diameter calculating means 153, 203 and the roll core rotational speed calculating means 156, 206 of the controller 140 determine a roll diameter D1 of the roll core 63 of the take-up device 62 and a roll diameter D2 of the roll core 25 of the blank web 24, respectively, based on the reference motor speed Vg from the commander unit from the commander unit 142 and the frequencies fa1, fa2 supplied from the respective pulse generators 26*b*, 62*b*.

In step S6, mainly the variable tension quantity calculating means 162, 212 of the controller 140 determines variable quantities ΔT1, ΔT2 of the tensions T to be applied respectively to the narrow web 50 and the wide web 22, based on the tension varying ratio settings γ1, γ2 and the roll diameters D1, D2 determined in step S5.

Furthermore, mainly the weight displacement calculating means 164, 214 of the controller 140 determine desired displacements La, Lb for the weight members 106 based on the variable quantities ΔT1, ΔT2 and the tension settings T01, T02.

In step S7, mainly the command weight position calculating means 166, 216 of the controller 140 determine command angular displacements θb1, θb2 based on the displacements La, Lb determined in step S6, and supply the determined the command angular displacements θb1, θb2 as positional commands to the motors 100.

The motors 100 are rotated to displace the weight members 106 for thereby controlling the tensions T applied to the narrow web 50 and the wide web 22, respectively.

In step S8, the controller 140 decides whether the operation of the web cutting apparatus 10 is to be stopped or not. Specifically, the controller 140 monitors whether a shutdown command has been supplied from the commander unit 142 or not. If a shutdown command has been supplied from the commander unit 142, i.e., if YES in step S8, then control proceeds to step S9 in which the controller 140 stops the operation of the web cutting apparatus 10. If no shutdown command has been supplied from the commander unit 142, i.e., if NO in step S8, then control returns to step S5, and the processing in steps S5 through S8 is repeated.

In step S9, the controller 140 outputs shutdown instructions to the payout unit 12, the payout tension adjuster 13, the reference unit 14, the slitting unit 16, the winding tension adjuster 17, and the take-up unit 18. Based on the startup instructions, the payout unit 12, the payout tension adjuster 13, the reference unit 14, the slitting unit 16, the winding tension adjuster 17, and the take-up unit 18 are shut off, i.e., the web cutting apparatus 10 stops its operation.

As described above, the weight member 106 is displaced by the ball screw 94 to displace the center of gravity of the support assembly 74 that supports the roll 90, thereby changing the tension T that is applied to the narrow web 50 or the wide web 22 via the roll 90.

Therefore, the tension T can be controlled quickly and accurately based on the angular displacement of the motor 100 that rotates the ball screw 94 about its own axis.

Furthermore, the tension T applied to the narrow web 50 or the wide web 22 can continuously be controlled while the web cutting apparatus 10 is in operation.

The tension T to be applied to the narrow web 50 or the wide web 22 is controlled based on the roll diameter D1 of the roll core 63 that includes the thickness of the narrow web 50 that has already been wound and also the roll diameter D2 of the roll core 25 that includes the thickness of the wide web 22 that remains wound.

Consequently, the narrow web 50 or the wide web 22 is reliably prevented from being degraded in quality when it is wound or unwound, or specifically, the narrow web 50 or the wide web 22 is reliably prevented from being damaged when it is tightened in its roll.

Although a certain preferred embodiment of the present invention has been shown and described in detail, it should be understood that various changes and modifications may be made therein without departing from the scope of the appended claims.

What is claimed is:

1. A dancer roll mechanism comprising:

a support assembly rotatably supported by a rotatable shaft;

a dancer roll rotatably supported by said support assembly; and a center-of-gravity displacing mechanism for displacing the center of gravity of said support assembly, said center-of-gravity displacement mechanism including:

a weight member; and a weight displacement assembly for displacing said weight member.

2. A dancer roll mechanism according to claim 1, wherein said weight displacing assembly comprises:

a ball screw extending substantially perpendicularly to the axis of said rotatable shaft;

an actuator for rotating said ball screw about its own axis; and a nut member threaded over said ball screw for movement along the axis of said ball screw in response to rotation of said ball screw about its own axis;

said weight member being mounted on said nut member.

3. A dancer roll mechanism according to claim 2, further comprising:

a counterweight mounted on said support assembly.

4. A web feeding apparatus comprising:

a plurality of web feed rolls for feeding a web; and a dancer roll mechanism for adjusting the tension applied to said web;

said dancer roll mechanism comprising:

a support assembly rotatably supported by a rotatable shaft;

a dancer roll rotatably supported by said support assembly; and a center-of-gravity displacing mechanism for displacing the center of gravity of said support assembly, said center-of-gravity displacement mechanism including:

a weight member; and a weight displacement assembly for displacing said weight member.

5. A web feeding apparatus according to claim 4, wherein said weight displacing assembly comprises:

a ball screw extending substantially perpendicularly to the axis of said rotatable shaft;

an actuator for rotating said ball screw about its own axis; and a nut member threaded over said ball screw for movement along the axis of said ball screw in response to rotation of said ball screw about its own axis;

said weight member being mounted on said nut member.

6. A web feeding apparatus according to claim 5, further comprising:

a counterweight mounted on said support assembly.

7. A web feeding apparatus according to claim 6, further comprising:

a roll core for winding or unwinding said web; and control means for determining a tension to be applied to said web based on the diameter of said roll core, which includes the thickness of said web, wound on said roll core;

the arrangement being such that the center of gravity of said support assembly in said dancer roll mechanism is controlled based on said tension determined by said control means.

8. A web feeding apparatus according to claim 7, wherein said control means comprises means for determining said tension in inverse proportion to the diameter of said roll core.

9. A web feeding apparatus according to claim 5, further comprising:

a roll core for winding or unwinding said web; and control means for determining a tension to be applied to said web based on the diameter of said roll core, which includes the thickness of said web, wound on said roll core;

the arrangement being such that the center of gravity of said support assembly in said dancer roll mechanism is controlled based on said tension determined by said control means.

10. A web feeding apparatus according to claim 9, wherein said control means comprises means for determining said tension in inverse proportion to the diameter of said roll core.

11. A web feeding apparatus according to claim 4, further comprising:

a roll core for winding or unwinding said web; and control means for determining a tension to be applied to said web based on the diameter of said roll core, which includes the thickness of said web, wound on said roll core;

the arrangement being such that the center of gravity of said support assembly in said dancer roll mechanism is controlled based on said tension determined by said control means.

12. A web feeding apparatus according to claim 11, wherein said control means comprises means for determining said tension in inverse proportion to the diameter of said roll core.

13. A web feeding apparatus comprising:

a plurality of web feed rolls for feeding a web;

a dancer roll mechanism for adjusting the tension applied to said web;

said dancer roller mechanism comprising:

a support assembly rotatably supported by a rotatable shaft;

a dancer roll rotatably supported by said support assembly; and a center-of-gravity displacing mechanism for displacing the center of gravity of said support assembly;

a roll core for winding or unwinding said web; and control means for determining a tension to be applied to said web based on the diameter of said roll core, which includes the thickness of said web, wound on said roll core;

the arrangement being such that the center of gravity of said support assembly in said dancer roll mechanism is controlled based on said tension determined by said control means.

14. A web feeding apparatus according to claim 13, wherein said control means comprises means for determining said tension in inverse proportion to the diameter of said roll core.

* * * * *